US009409407B2

(12) United States Patent
Kudo et al.

(10) Patent No.: US 9,409,407 B2
(45) Date of Patent: Aug. 9, 2016

(54) LIQUID EJECTION APPARATUS AND TANK

(71) Applicant: SEIKO EPSON CORPORATION, Tokyo (JP)

(72) Inventors: Shoma Kudo, Nagano (JP); Naomi Kimura, Nagano (JP); Hidenao Suzuki, Nagano (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/760,507

(22) PCT Filed: Jan. 10, 2014

(86) PCT No.: PCT/JP2014/000093
§ 371 (c)(1),
(2) Date: Jul. 13, 2015

(87) PCT Pub. No.: WO2014/112344
PCT Pub. Date: Jul. 24, 2014

(65) Prior Publication Data

US 2015/0352853 A1 Dec. 10, 2015

(30) Foreign Application Priority Data

Jan. 18, 2013 (JP) ..... 2013-006996

(51) Int. Cl.
*B41J 2/175* (2006.01)
*B41J 29/02* (2006.01)
*B41J 29/13* (2006.01)

(52) U.S. Cl.
CPC ..... *B41J 2/17523* (2013.01); *B41J 2/175* (2013.01); *B41J 2/17513* (2013.01); *B41J 2/17553* (2013.01); *B41J 29/02* (2013.01); *B41J 29/13* (2013.01)

(58) Field of Classification Search
CPC ..... B41J 2/175
See application file for complete search history.

(56) References Cited

U.S. PATENT DOCUMENTS

| | | | | |
|---|---|---|---|---|
| 2005/0151782 | A1 | 7/2005 | Ishida et al. | |
| 2009/0058917 | A1 * | 3/2009 | Takata | B41J 2/175 347/18 |
| 2012/0013687 | A1 * | 1/2012 | Ishizawa | B41J 2/175 347/85 |
| 2012/0182364 | A1 | 7/2012 | Takeda et al. | |

FOREIGN PATENT DOCUMENTS

| | | | |
|---|---|---|---|
| JP | 2006-035662 | A | 2/2006 |
| JP | 2011-126292 | A | 6/2011 |
| JP | 2012-144016 | A | 8/2012 |
| JP | 2013-000949 | A | 1/2013 |

* cited by examiner

*Primary Examiner* — Geoffrey Mruk
(74) *Attorney, Agent, or Firm* — Global IP Counselors, LLP

(57) ABSTRACT

A liquid ejection apparatus includes a tank; a liquid ejection head; and a casing configured to integrally cover the tank and the liquid ejection head. The tank includes a container portion configured to contain a liquid, an air introducing path arranged to introduce the air into the container portion, an inlet port configured to pour the liquid into the container portion, and an outlet port formed to supply the liquid into the liquid ejection head. In an attitude that the liquid is ejectable from the liquid ejection head, the liquid is contained in the container portion such that a liquid level of the liquid in the container portion is located at a higher position than a nozzle of the liquid ejection head in a vertical direction. In the attitude that the liquid is ejectable from the liquid election head, the inlet port is covered by the casing.

12 Claims, 12 Drawing Sheets

LIQUID EJECTION APPARATUS AND TANK

CROSS-REFERENCE TO RELATED APPLICATIONS

This application is a national phase application of International Application No. PCT/JP2014/000093 filed on Jan. 10, 2014. This application claims priority to Japanese Patent Application No. 2013-006996 filed on Jan. 18, 2013. The entire disclosure of Japanese Patent Application No. 2013-006996 is hereby incorporated herein by reference.

TECHNICAL FIELD

The present invention relates to a liquid ejection apparatus and a tank or the like.

BACKGROUND ART

An inkjet printer that is one type of a liquid ejection apparatus performs printing on a printing medium such as printing paper by ejecting ink that is one example of a liquid from a liquid ejection head onto the printing medium. A conventionally known configuration of this inkjet printer includes an ink tank provided to store ink. For example, Japanese Laid-Open Patent Application Publication No. 2012-144016A discloses one exemplified configuration of increasing the capacity of an ink tank. In this configuration, in an attitude that ink is ejectable from a liquid ejection head, a liquid level in a liquid chamber is located at a higher position than a nozzle of the liquid ejection head, and a liquid inlet port communicating with the liquid chamber is sealed with a plug member. In order to take the air from outside into the liquid chamber, the other end of a communication path having one end communicating with an air hole is located at a lower position than the nozzle of the liquid ejection head in the liquid chamber. A meniscus is formed in the communication path, so as to stabilize ink supply to the liquid ejection head.

SUMMARY

In the attitude that ink is ejectable from the liquid ejection head, at some position of the liquid level, accidental removal of the plug member is likely to make the liquid chamber communicate with the outside air via the liquid inlet port and thereby deteriorate the stability of ink supply to the liquid ejection head.

In the configuration of Japanese Laid-Open Patent Application Publication No. 2012-144016A, the ink tank is placed in a container unit externally attached to a casing of the inkjet printer. In the course of detaching the container unit for the purpose of pouring ink into the ink tank, the liquid inlet port with the plug member placed therein is exposed outside. This configuration is more likely to cause accidental removal of the plug member.

An object of the invention is thus to provide a liquid ejection apparatus that employs an ink tank including a liquid chamber that maintains a liquid level at a higher position than a nozzle of a liquid ejection head and that a plug member placed in a liquid inlet port is unlikely to be accidentally removed.

The invention may be implemented by the following aspects or embodiments.

According to one aspect, there is provided a liquid ejection apparatus. The liquid ejection apparatus may comprise a tank that is configured to contain a liquid; a liquid ejection head that communicates with the tank and is configured to eject the liquid; a casing that is configured to place the tank and the liquid ejection head inside thereof and a cover that is configured to cover the casing. The tank may include a container portion that is configured to contain the liquid, an air introducing path that is arranged to introduce the air into the container portion, an inlet port that is configured to pour the liquid into the container portion, a sealing member that is configured to seal the inlet port, and an outlet port that is formed to supply the liquid through a tube into the liquid ejection head. In an attitude that the liquid is ejectable from the liquid ejection head, the liquid may be contained in the container portion such that a liquid level of the liquid in the container portion is located at a higher position than a nozzle of the liquid ejection head in a vertical direction; an inlet port that is an opening of the air introducing path on a container portion side thereof may be located at a lower position than the nozzle of the liquid ejection head in the vertical direction; and the sealing member may be covered by part of the cover.

In the configuration of this aspect, the casing of the liquid ejection apparatus integrally covers the tank and the liquid ejection head, and additionally the casing also covers the sealing member of the tank. In the attitude of the liquid ejection apparatus that the liquid is ejectable from the liquid ejection head, this configuration reduces the likelihood that the sealing member is accidentally removed by, for example, the operator's improper use. The inlet port configured to introduce the air outside of the tank into the container portion is located at the lower position than the nozzle of the liquid ejection head in the vertical direction. This configuration is more likely to suppress a variation in pressure applied to the liquid flowing out of the tank and thereby facilitates the pressure of the liquid supplied from the tank to the liquid ejection head to be maintained at a constant level.

In the liquid ejection apparatus of the above aspect, the cover may constitute part of a scanner unit.

In this aspect, the cover constitutes part of the scanner unit. This provides the liquid ejection apparatus with a simple configuration including the functions of the scanner.

In the liquid ejection apparatus of the above aspect, the tank may further include an air chamber that communicates with the container portion via the air introducing path, and an air communication port that is formed to introduce the air into the air chamber.

In this aspect, even when the liquid ejection apparatus is inclined to cause the liquid in the container portion to enter the air introducing path, the liquid is retained in the air chamber before being leaked out through the air communication port. This configuration accordingly suppresses leakage of ink from the liquid ejection apparatus.

In the liquid ejection apparatus of the above aspect, the container portion may be extended in a first direction that is a longitudinal direction of the container portion. A dimension of the container portion in the first direction may be longer than a dimension of the container portion in a direction perpendicular to the first direction. At least part of an area of the tank overlapping the container portion may have optical transparency along the first direction. At least an area of the casing overlapping the part of the area of the tank having optical transparency may have optical transparency.

In this aspect, the liquid in the container portion is visible via the area of the tank having optical transparency. The area of the casing having optical transparency overlaps the area of the tank having optical transparency, so that the liquid in the container portion is visible from outside of the casing. The liquid ejection apparatus of this aspect thus enables the liquid in the tank to be visually checked from outside of the casing. Additionally, in this liquid ejection apparatus, at least part of the area of the tank overlapping the container portion has optical transparency along the first direction. Accordingly, this liquid ejection apparatus causes the liquid in the tank to be visible along the longitudinal direction of the container portion. This configuration enables the liquid in the tank to be visually checked over a wide range of the container portion, thus improving the visibility of the liquid.

In the liquid ejection apparatus of the above aspect, the first direction may intersect with a horizontal direction.

In this aspect, the first direction is the direction intersecting with the horizontal direction, so that the container portion is inclined to the horizontal direction. The liquid in the container portion is thus accumulated on one end side of the container portion in the longitudinal direction. This facilitates the remaining amount of the liquid to be visually checked relative to the length of the container portion in the first direction.

In the liquid ejection apparatus of the above aspect, a sectional area of the container portion cut in a direction perpendicular to the first direction may be constant along the first direction.

In this aspect, the sectional area of the container portion cut in the direction perpendicular to the first direction is constant along the first direction. This provides a constant proportionality factor between the amount of consumption of the liquid in the container portion and the amount of displacement of the liquid level. This facilitates prediction of a change in remaining amount of the liquid.

In the liquid ejection apparatus of the above aspect, an optically transparent area of the casing that is the area having optical transparency may be configured on a front side of the liquid ejection apparatus.

In this aspect, the optically transparent area of the casing is configured on the front side of the liquid consuming apparatus. This configuration facilitates the visual recognition by the operator who faces the front of the liquid consuming apparatus.

According to another aspect, in a liquid ejection apparatus that includes a tank that is configured to contain a liquid; a liquid ejection head that communicates with the tank and is configured to eject the liquid; a casing that is configured to place the tank and the liquid ejection head inside thereof and a cover that is configured to cover the casing, there is configured the tank. The tank may comprise a container portion that is configured to contain the liquid; an air introducing path that is arranged to introduce the air into the container portion; an inlet port that is configured to pour the liquid into the container portion; a sealing member that is configured to seal the inlet port; and an outlet port that is formed to supply the liquid through a tube into the liquid ejection head. In an attitude that the liquid is ejectable from the liquid ejection head, the liquid may be contained in the container portion such that a liquid level of the liquid in the container portion is located at a higher position than a nozzle of the liquid ejection head in a vertical direction. In the attitude that the liquid is electable from the liquid ejection head, the sealing member may be covered by part of the cover.

In this aspect, the tank, along with the liquid ejection head, is placed inside of the casing of the liquid ejection apparatus. Additionally, the sealing member of the tank is covered by part of the cover. In the attitude of the liquid ejection apparatus that the liquid is ejectable from the liquid ejection head, this configuration reduces the likelihood that the sealing member is accidentally removed from the tank by, for example, the operator's improper use.

In the tank of the above aspect, in the attitude that the liquid is electable from the liquid ejection head, an inlet port that is an opening of the air introducing path on a container portion side thereof may be located at a lower position than the nozzle of the liquid ejection head in the vertical direction.

In this aspect, the inlet port configured to introduce the air outside of the tank into the container portion is located at the lower position than the nozzle of the liquid ejection head in the vertical direction. This configuration is more likely to suppress a variation in pressure applied to the liquid flowing out of the tank and thereby facilitates the pressure of the liquid supplied from the tank to the liquid ejection head to be maintained at a constant level.

In the tank of the above aspect, the container portion may be extended in a first direction that is a longitudinal direction of the container portion. A dimension of the container portion in the first direction may be longer than a dimension of the container portion in a direction perpendicular to the first direction. At least part of an area of the tank overlapping the container portion may have optical transparency in the first direction. A sectional area of the container portion cut in a direction perpendicular to the first direction may be constant along the first direction.

In this aspect, the sectional area of the container portion cut in the direction perpendicular to the first direction is constant along the first direction. This provides a constant proportionality factor between the amount of consumption of the liquid in the container portion and the amount of displacement of the liquid level. This facilitates prediction of a change in remaining amount of the liquid.

DESCRIPTION OF EMBODIMENTS

Figure 1:
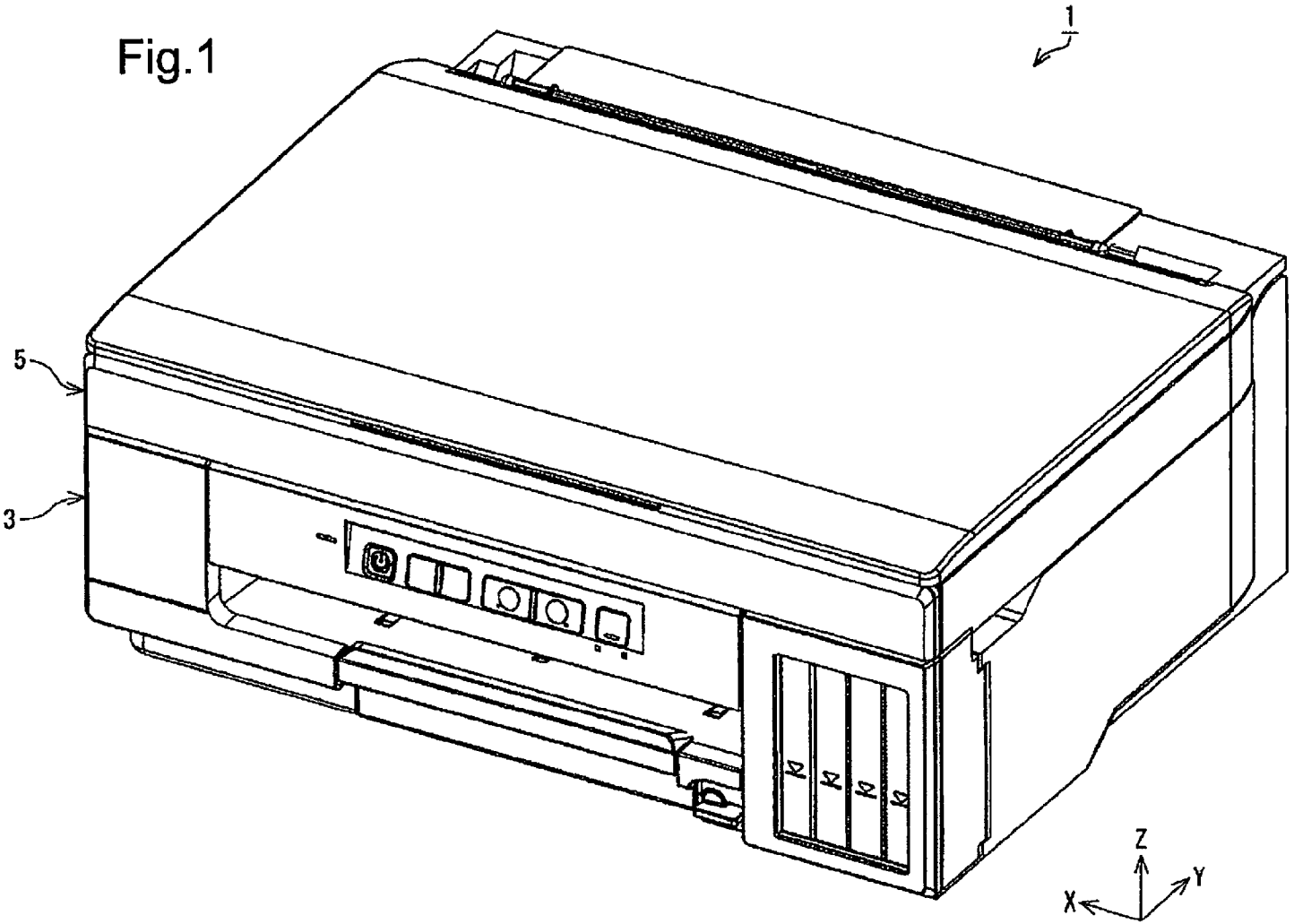
FIG. 1 is a perspective view illustrating a multifunction printer according to an embodiment.

The following describes a multifunction printer as one example of a liquid ejection apparatus according to an embodiment with reference to drawings. The multifunction printer 1 of the embodiment includes a printer 3 and a scanner unit 5 as shown in FIG. 1. In the multifunction printer 1, the printer 3 and the scanner unit 5 are stacked. In the use state of the printer 3, the scanner unit 5 is placed vertically on the printer 3. XYZ axes as coordinate axes that are orthogonal to one another are shown in FIG. 1. The XYZ axes are also added as appropriate in subsequent drawings. In the state of FIG. 1, the printer 3 is placed on a horizontal plane (XY plane) defined by an X-axis direction and a Y-axis direction. A Z-axis direction is a direction orthogonal to the XY plane, and −Z-axis direction represents vertically downward.

Figure 2:
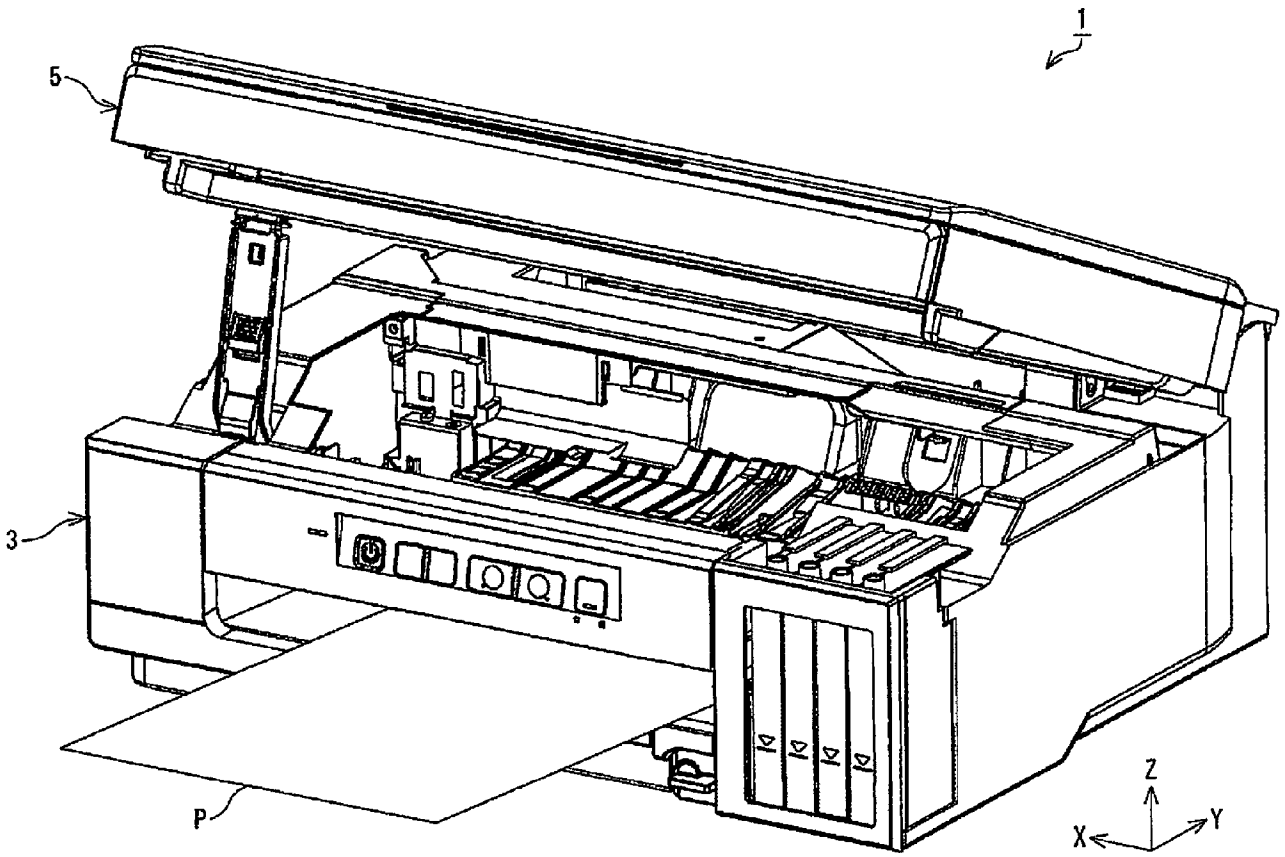
FIG. 2 is a perspective view illustrating the multifunction printer of the embodiment.

The scanner unit 5 is flatbed type having an imaging element (not shown) such as an image sensor, a platen and a cover. The scanner unit 5 is capable of reading an image or the like recorded on a medium such as paper via the imaging element in the form of image data. The scanner unit 5 accordingly serves as a reader of the image or the like. As shown in FIG. 2, the scanner unit 5 is provided to be rotatable relative to a casing 7 of the printer 3. A printer 3-side surface of the platen of the scanner unit 5 also serves as a cover of the printer 3 to cover the casing 7 of the printer 3.

Figure 3:
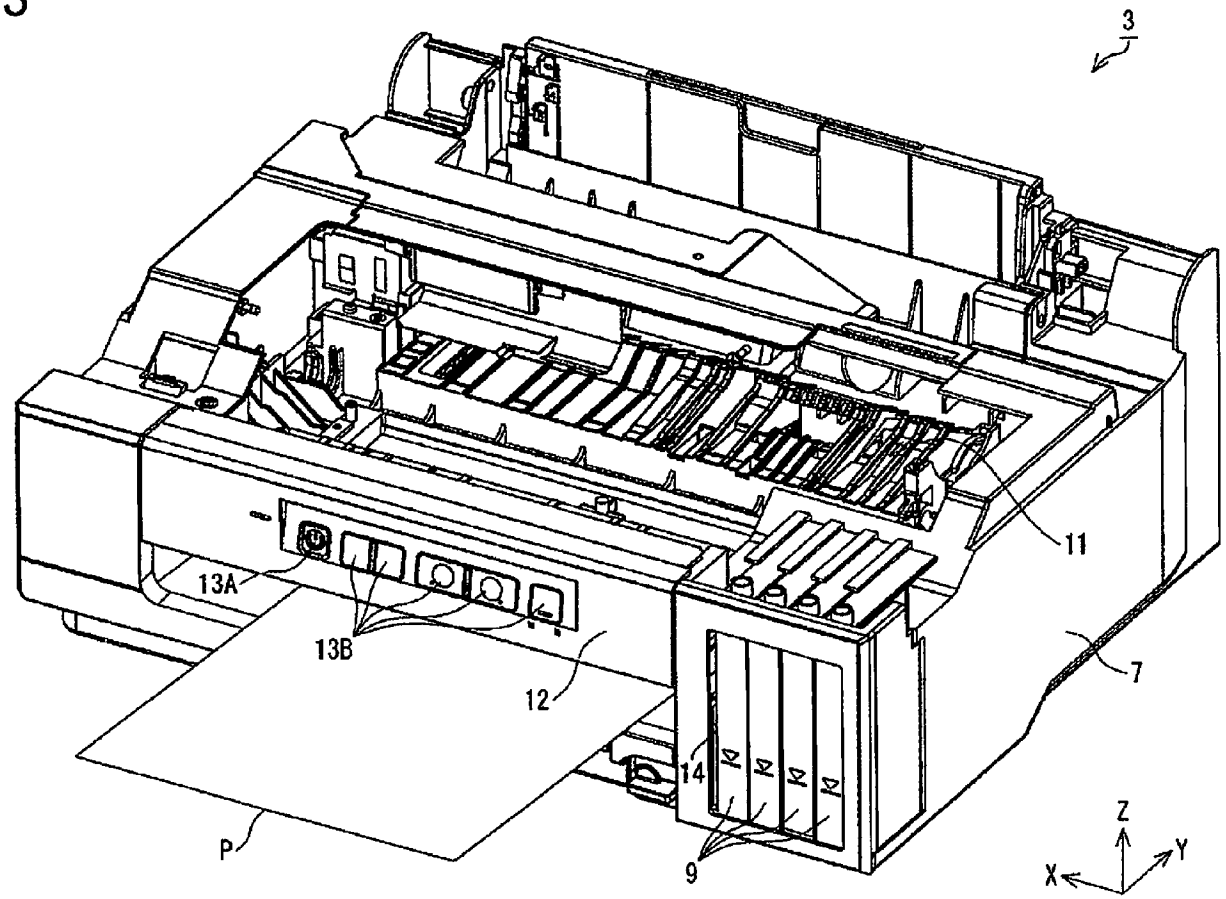
FIG. 3 is a perspective view illustrating a printer of the embodiment.

The printer 3 performs printing on a printing medium P such as printing paper with ink as one example of liquid. As shown in FIG. 3, the printer 3 includes the casing 7 and a plurality of tanks 9. The casing 7 is an integrally molded component that forms an outer shell of the printer 3 and includes mechanics 11 of the printer 3. The plurality of tanks 9 are placed inside of the casing 7 to respectively contain inks used for printing. This embodiment provides four tanks 9. The four tanks 9 respectively contain different inks. This embodiment employs four different inks, i.e., black, yellow, magenta and cyan. Each of the four tanks 9 is provided to contain a different ink.

The printer 3 also has an operation panel 12. The operation panel 12 is provided with a power button 13A and other operation buttons 13B. An operator who operates the printer 3 faces the operation panel 12 to operate the power button 13A and the operation buttons 13B. A front face of the printer 3 is a surface where the operation panel 12 is provided. The casing 7 has a window 14 provided on the front face of the printer 3. The window 14 has optical transparency. The four tanks 9 described above are placed at a position overlapping the window 14. This configuration enables the operator to observe the four tanks 9 through the window 14.

According to this embodiment, a region of each of the tank 9 facing the window 9 has optical transparency, so that ink contained in the tank 9 is visible through the region of the tank 9 having optical transparency. This enables the operator to observe the four tanks 9 through the window 14 and thereby visually check the amounts of inks remaining in the respective tanks 9. According to this embodiment, the window 14 is provided on the front surface of the printer 3. This configuration enables the operator facing the operation panel 12 to visually recognize the respective tanks 9 through the window 14. This accordingly enables the operator to check the remaining amounts of inks in the respective tanks 9 while operating the printer 3.

Figure 4:
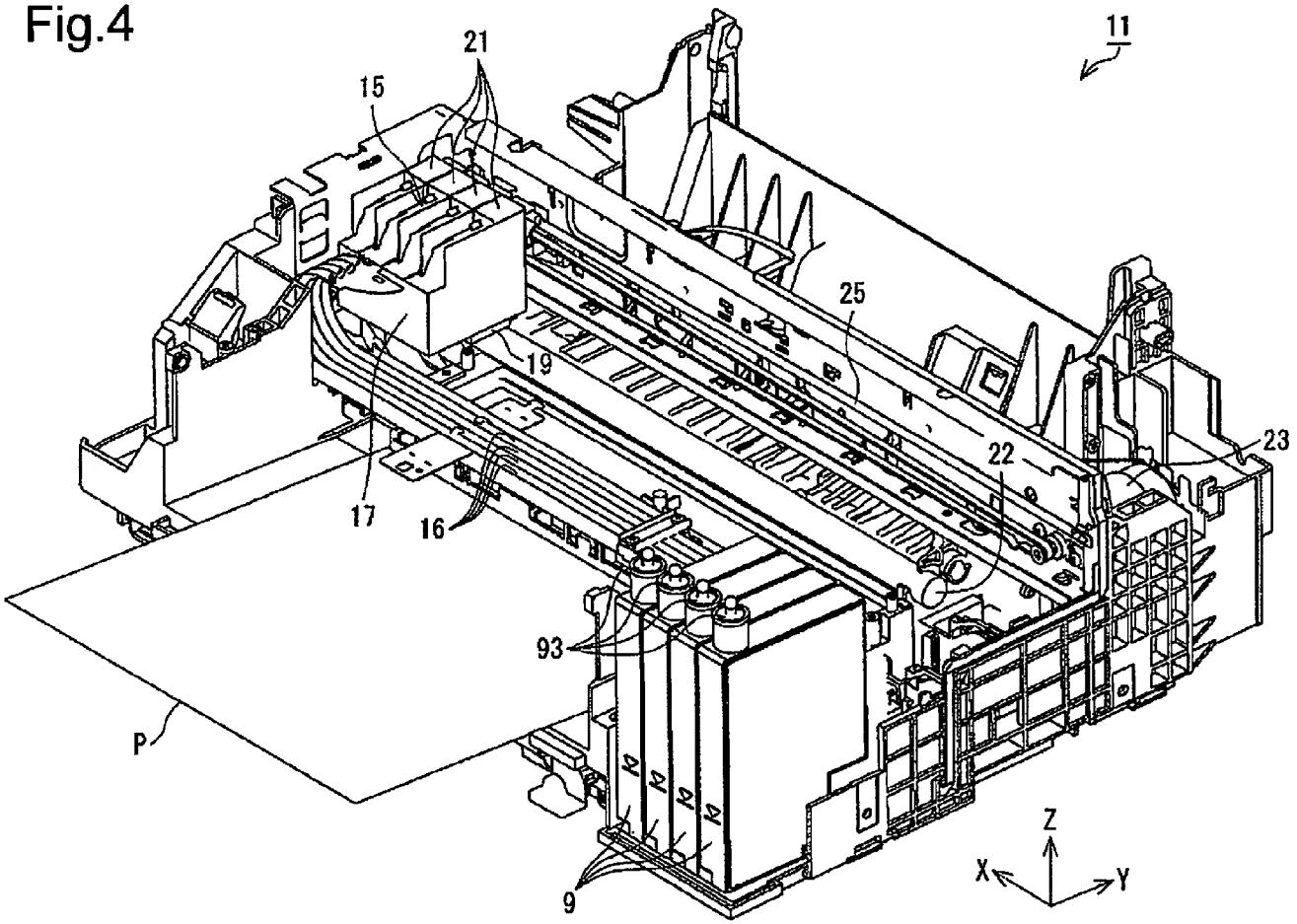
FIG. 4 is a perspective view illustrating mechanics of the printer of the embodiment.

As shown in FIG. 4 that is a schematic diagram of the mechanics 11, the printer 3 includes a liquid ejection assembly 15 and supply tubes 16. The liquid ejection assembly 15 includes a carriage 17, a liquid ejection head 19 and four relay units 21. The liquid ejection head 19 and the four relay units 21 are mounted on the carriage 17. The supply tubes 16 are flexible and are provided between the tanks 9 and the relay units 21. The tank 9 has an inlet port 61 (described later) provided with a plug 93. The plug 93 is covered by part of the scanner unit 5 that serves as a cover of the printer 3. The ink contained in each of the tanks 9 is supplied through the supply tube 16 to the relay unit 21. The relay unit 21 relays the ink which is supplied from the tank 9 through the supply tube 16, to the liquid ejection head 19. The liquid ejection head 19 ejects the supplied ink from a nozzle 20 (described later) in the form of ink droplets. The cover of the printer 3 to cover over the plug 93 is not limited to the configuration using the platen of the scanner unit 5 but may be a cover of the scanner unit 5 itself.

The printer 3 also has a medium feeding mechanism (not shown) and a head carrying mechanism (not shown). The medium feeding mechanism drives a feed roller 22 by the power from a motor (not shown), so as to feed a printing medium P in the Y-axis direction. The head carrying mechanism transmits the power from a motor 23 via a timing belt 25 to the carriage 17, so as to carry the carriage 17 along the X-axis direction. As described above, the liquid ejection head 19 is mounted on the carriage 17. The liquid ejection head 19 is thus movable in the X-axis direction via the carriage 17 by the head carrying mechanism. The medium feeding mechanism and the head carrying mechanism cause ink to be ejected from the liquid ejection head 19 while changing the position of the liquid ejection head 19 relative to the printing medium P, so as to complete printing on the printing medium P.

First Embodiment

Figure 5:
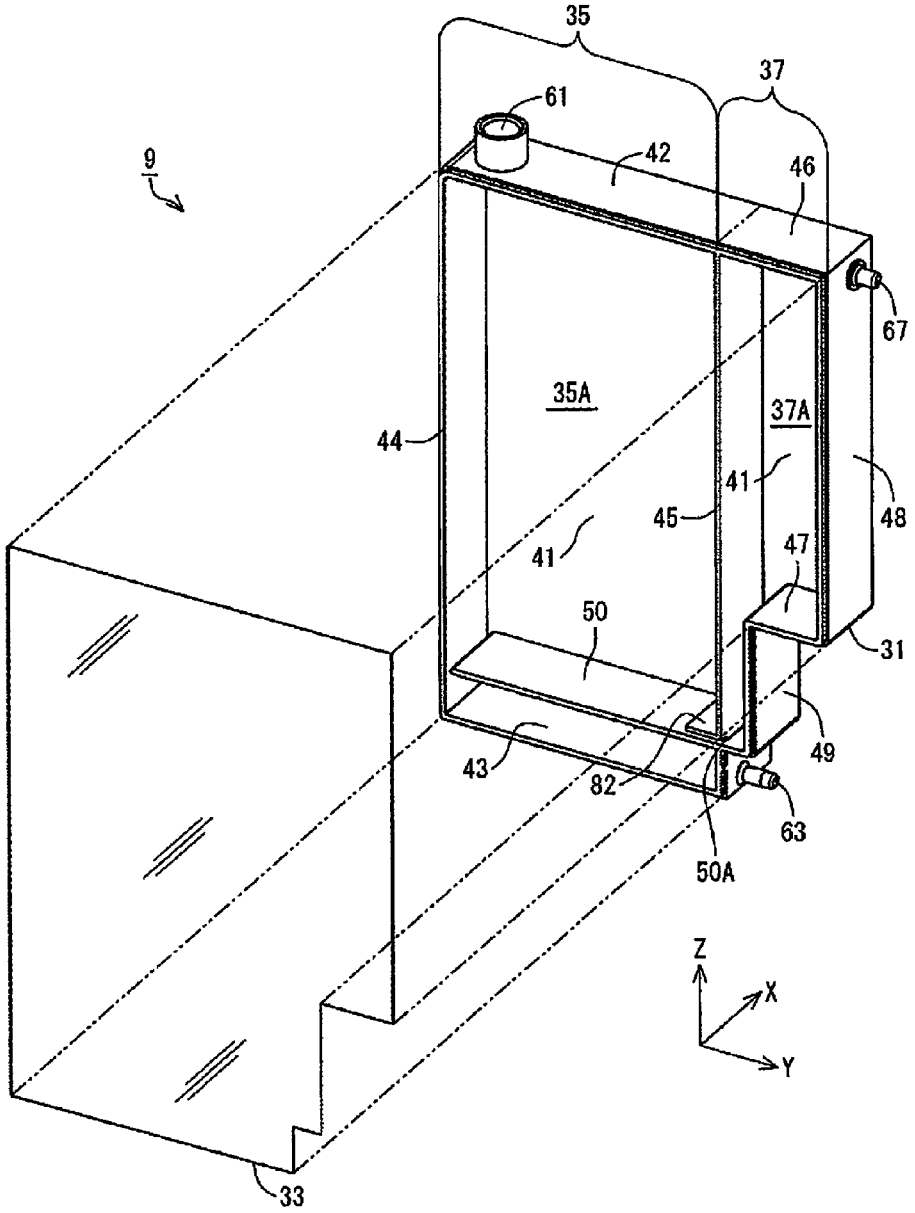
FIG. 5 is an exploded perspective view illustrating the schematic configuration of a tank according to a first embodiment.

The tank 9 has a casing 31 and a sheet member 33 as shown in FIG. 5. The casing 31 is made of a synthetic resin such as nylon or polypropylene. The sheet member 33 is made of a synthetic resin (for example, nylon or polypropylene) in a film-like shape and has flexibility. The casing 31 includes a container portion 35 and an air chamber 37.

The container portion 35 includes first wall 41, a second wall 42, a third wall 43, a fourth wall 44 and a fifth wall 45. The second wall 42, the third wall 43, the fourth wall 44 and the fifth wall 45 are arranged to intersect with the first wall 41 respectively. The second wall 42 and the third wall 43 are located to face each other across the first wall 41 in the Z-axis direction. The fourth wall 44 and the fifth wall 45 are located to face each other across the first wall 41 in the Y-axis direction. The second wall 42 intersects with both the fourth wall 44 and the fifth wall 45. The third wall 43 also intersects with both the fourth wall 44 and the fifth wall 45. In the printer 3 shown in FIG. 3, the fourth wall 44 faces the window 14. According to this embodiment, the tank 9 is made of a material having optical transparency.

In the planar view, the first wall 41 shown in FIG. 5 is surrounded by the second wall 42, the third wall 43, the fourth wall 44 and the fifth wall 45. The second wall 42, the third wall 43, the fourth wall 44 and the fifth wall 45 are protruded from the first wall 41 in the −X-axis direction. Accordingly, the container portion 35 is formed in a recessed shape by the first wall 41 as bottom as well as the second wall 42, the third wall 43, the fourth wall 44 and the fifth wall 45. A recess 35A is formed by the first wall 41, the second wall 42, the third wall 43, the fourth wall 44 and the fifth wall 45. The recess 35A is formed to be concave in the +X-axis direction. The recess 35A is open in the −X-axis direction, i.e., on the sheet member 33-side. Ink is contained in the recess 35A.

According to this embodiment, in the container portion 35, a length of the fourth wall 44 along the Z-axis direction is longer than a length of the second wall 42 along the Y-axis direction. In other words, in the container portion 35, a dimension along the Z-axis direction is longer than a dimension along a direction perpendicular to the Z-axis direction. The container portion 35 is accordingly in a long shape along the Z-axis direction. The container portion 35 is extended in the Z-axis direction as its longitudinal direction.

The air chamber 37 is provided on an opposite side to a recess 35A-side of the fifth wall 45. The air chamber 37 is protruded from the fifth wall 45 on an opposite side to a fourth wall 44-side of the fifth wall 45, i.e., on a +Y-axis direction side of the fifth wall 45. The air chamber 37 includes a first wall 41, the fifth wall 45, a sixth wall 46, a seventh wall 47, an eighth wall 48, a ninth wall 49 and a tenth wall 50. The first wall 41 of the container portion 35 is identical with the first wall 41 of the air chamber 37. In other words, according to this embodiment, the container portion 35 and the air chamber 37 share the first wall 41. The second wall 42 and the sixth wall 46 are continuous with each other.

The sixth wall 46 is protruded from the fifth wall 45 on the opposite side to the fourth wall 44-side of the fifth wall 45, i.e., on the +Y-axis direction side of the fifth wall 45. The seventh wall 47 is located to face the sixth wall 46 across the first wall 41 of the air chamber 37 in the Z-axis direction. The sixth wall 46 and the seventh wall 47 are thus opposed to each other across the first wall 41 of the air chamber 37 in the Y-axis direction. The eighth wall 48 is located to face the fifth wall 45 across the first wall 41 of the air chamber 37 in the Y-axis direction. The ninth wall 49 is located to face the fifth wall 45 across the first wall 41 of the air chamber 37 in the Y-axis direction, on an opposite side to a sixth wall 46-side of the seventh wall 47, i.e., on a −Z-axis direction side of the seventh wall 47. The ninth wall 49 is located between the fifth wall 45 and the eighth wall 48 in the Y-axis direction. The seventh wall 47 is placed between the eighth wall 48 and the ninth wall 49.

The sixth wall 46 intersects with both the fifth wall 45 and the eighth wall 48. The seventh wall 47 intersects with both the eighth wall 48 and the ninth wall 49. The tenth wall 50 is located to face the sixth wall 46 and the second wall 42 across the first wall 41 of the air chamber 37 in the Z-axis direction, on an opposite side to a sixth wall 46-side of the ninth wall 49, i.e., on a −Z-axis direction side of the ninth wall 49. The tenth wall 50 is protruded from the seventh wall 47 on a fifth wall 45-side of the seventh wall 47, i.e., on a −Y-axis direction side of the seventh wall 47. The tenth wall 50 is arranged to intersect with the fifth wall 45 and to be protruded into the recess 35A. There is a clearance provided between the tenth wall 50 and the fourth wall 44.

In the planar view, the first wall 41 of the air chamber 37 is surrounded by the fifth wall 45, the sixth wall 46, the seventh wall 47, the eighth wall 48, the ninth wall 49 and the tenth wall 50. The fifth wall 45, the sixth wall 46, the seventh wall 47, the eighth wall 48, the ninth wall 49 and the tenth wall 50 are protruded from the first wall 41 in the −X-axis direction. Accordingly, the air chamber 37 is formed in a recessed shape by the first wall 41 as bottom and the fifth wall 45, the sixth wall 46, the seventh wall 47, the eighth wall 48, the ninth wall 49 and the tenth wall 50. A recess 37A of the air chamber 37 is formed by the first wall 41, the fifth wall 45, the sixth wall 46, the seventh wall 47, the eighth wall 48, the ninth wall 49 and the tenth wall 50. The recess 37A is formed to be concave in the +X-axis direction. The recess 37A is open in the −X-axis direction, i.e., on the sheet member 33-side. The recess 35A and the recess 37A are separated from each other by the fifth wall 45. The amounts of protrusion of the second wall 42 to the tenth wall 50 from the first wall 41 are set to an identical protrusion amount, except a cutout 50A of the fifth wall 45. The cutout 50A of the fifth wall 45 is located on the first wall 41-side of a sheet member 33-side end of the fifth wall 45.

An inlet port 61 is provided on the second wall 42. A supply port 63 is provided on the fifth wall 45. An air communication port 67 is provided on the eighth wall 48. The supply port 63 is located between the third wall 43 and the tenth wall 50 in the Z-axis direction. The inlet port 61 and the supply port 63 respectively serve to make outside of the casing 31 communicate with inside of the recess 35A. The air communication port 67 serves to make outside of the casing 31 communicate with inside of the recess 37A. The inlet port 61 is open in the longitudinal direction (Z-axis direction) of the fourth wall 44. The supply port 63 and the air communication port 67 are respectively open in a direction intersecting with the longitudinal direction of the fourth wall 44.

Figure 6:
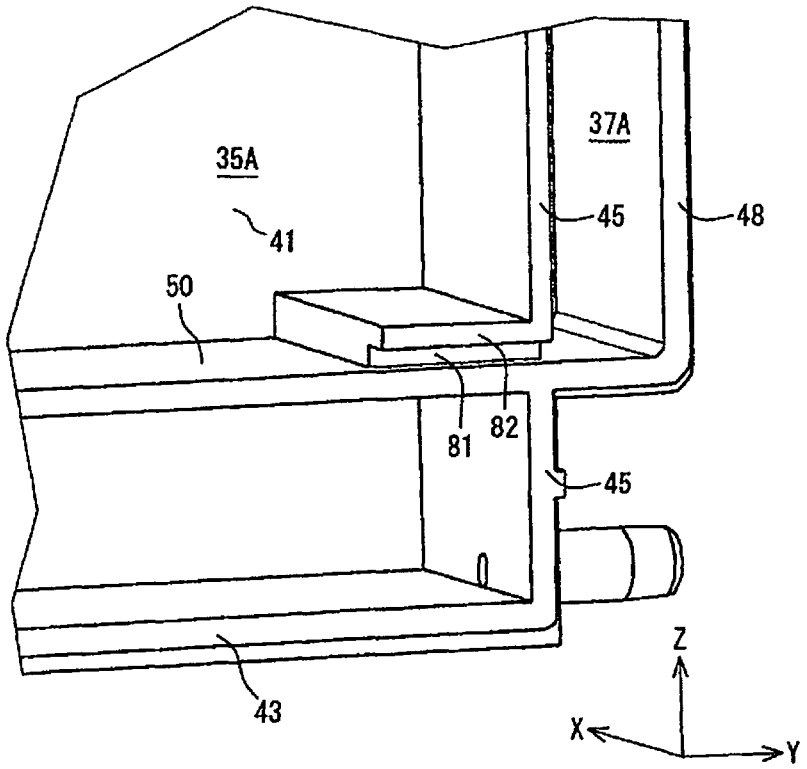
FIG. 6 is a sectional view illustrating a communication path of the first embodiment.

As shown in FIG. 6, a communication path 81 is provided in the casing 31 to make the recess 37A and the recess 35A communicate with each other. The communication path 81 is parted by a partition wall 82 and the tenth wall 50 in the recess 35A. The partition wall 82 is protruded from the first wall 41 in the −X-axis direction, i.e., from the first wall 41 toward the sheet member 33, in the recess 35A. The partition wall 82 is continuous with the tenth wall 50 as shown in FIG. 6. The communication path 81 is formed as a groove in the partition wall 82. The communication path 81 provided as a groove in the partition wall 82 is formed to be concave in a direction from an opposite side end to a first wall 41-side of the partition wall 82 toward the first wall 41. The amount of protrusion of the partition wall 82 from the first wall 41 is set to be equal to the protrusion amounts of the second wall 42 to the tenth wall 50.

As shown in FIG. 5, the sheet member 33 is arranged to face the first wall 41 across the second wall 42 to the tenth wall 50 in the X-axis direction. In the planar view, the sheet member 33 has dimensions to cover the recess 35A and the recess 37A. The sheet member 33 is joined with respective ends of the second wall 42 to the tenth wall 50 and the partition wall 82 with keeping a clearance from the first wall 41. The recess 35A and the recess 37A are accordingly sealed by the sheet member 33. The sheet member 33 may thus be regarded as a cover for the casing 31.

Figure 7:
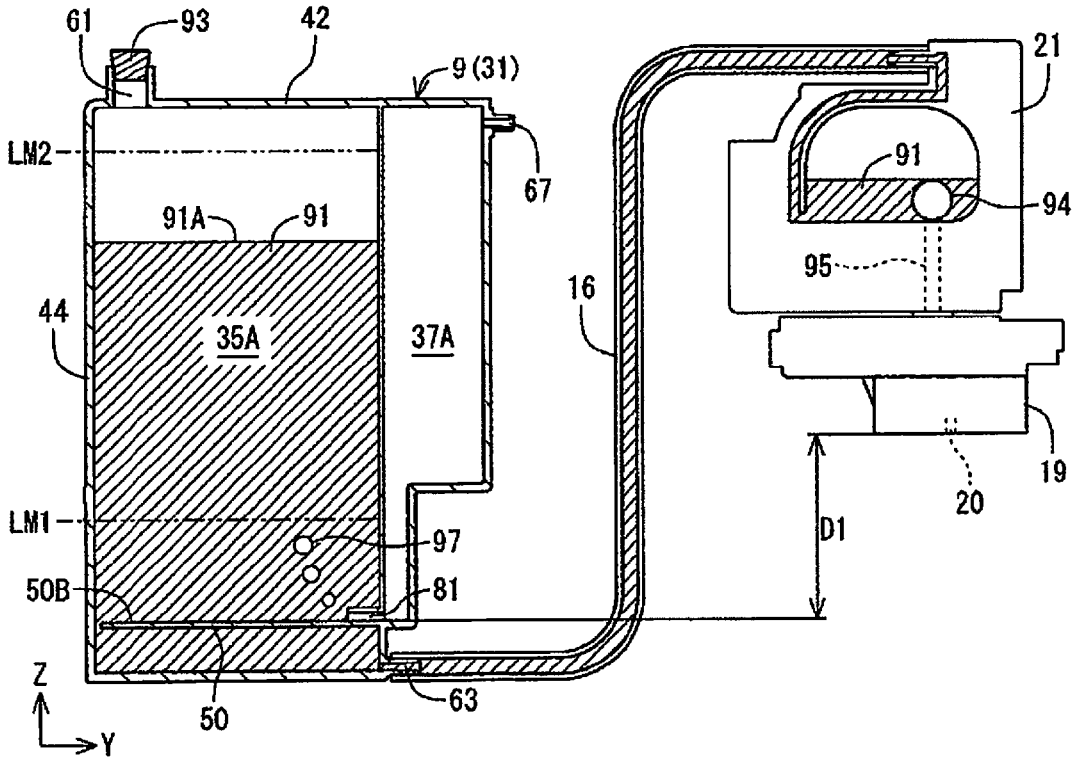
FIG. 7 is a diagram illustrating the flow of ink from the tank to a liquid ejection head according to the first embodiment.

In the tank 9, as shown in FIG. 7, ink 91 is contained inside of the recess 35A. FIG. 7 illustrates a section of the inlet port 61, the supply port 63, the air communication port 67 and the communication path 81 of the tank 9 cut along a YZ plane. The ink 91 in the recess 35A is supplied from the supply port 63 to the liquid ejection head 19. According to this embodiment, for example, in the use state of the printer 3 for printing, the supply tube 16 is connected with the supply port 63, and the inlet port 61 is closed by the plug 93. The supply tube 16 connects the supply port 63 with the relay unit 21. The ink 91 in the recess 35A is supplied from the supply port 63 through the supply tube 16 into the relay unit 21. The relay unit 21 is provided with a supply path 95 connecting with the liquid ejection head 19. The ink 91 in the relay unit 21 is flowed through a filter 94 and is supplied through the supply path 95 to the liquid ejection head 19.

The amount of the ink 91 in the relay unit 21 decreases with progress in printing by means of the liquid ejection head 19. During this time, the internal pressure of the relay unit 21 decreases to be lower than the atmospheric pressure. When the internal pressure of the relay unit 21 becomes lower than a negative pressure based on a head difference D1 between the tank 9 and the liquid ejection head 19, the ink 91 in the recess 35A is supplied through the supply tube 16 into the relay unit 21 due to this pressure difference. The head difference D1 corresponds to a difference in height in the vertical direction between an ink surface adjacent to the air chamber 37 in the tank 9 (in this embodiment, a surface 50B of the tenth wall 50 facing the second wall 42) and the nozzle 20 of the liquid ejection head 19.

According to this embodiment, the surface 50B is located vertically below a lower limit line LM1 indicating a lower limit of the amount of the ink 91 in the tank 9. The surface 50B is also located vertically above the supply port 63. In the state that a liquid level 91A of the ink 91 in the recess 35A is located between an upper limit line LM2 indicating an upper limit of the amount of the ink 91 in the tank 9 and the lower limit line LM1, this configuration reduces a variation in head difference D1 accompanied with a change in position of the liquid level 91A. As a result, this makes the ink 91 likely to be supplied stably to the liquid ejection head 19. This configuration is also likely to lower the height position in the vertical direction of the liquid ejection head 19 relative to the tank 9. Accordingly, this is likely to reduce the height dimension of the printer 3 in a configuration that the long tank 9 is stood in the vertical direction. This results in downsizing the printer 3 and the multifunction printer 1.

The amount of the ink 91 in the recess 35A decreases with progress in printing by means of the liquid ejection head 19. During this time, the internal pressure of the recess 35A decreases to be lower than the atmospheric pressure. When the internal pressure of the recess 35A becomes lower than the atmospheric pressure, the air 97 in the recess 37A is flowed through the communication path 81 into the recess 35A. The internal pressure of the recess 35A is thus more likely to be maintained at the atmospheric pressure. In the communication path 81, a meniscus is formed on the boundary between the ink 91 on the recess 35A-side and the air on the recess 37A-side. This suppresses the ink 91 in the recess 35A from being flowed into the recess 37A.

The ink 91 in the tank 9 is thus supplied to the liquid ejection head 19 as described above. When the ink 91 in the recess 35A of the tank 9 is consumed and the remaining amount of the ink 91 reaches the lower limit, the operator is allowed to refill the tank 9 with ink newly supplied from the inlet port 61. In the course of newly pouring ink into the tank 9, the air communication port 67 is closed, and the ink flow path from the supply port 63 to the nozzle 20 of the liquid ejection head 19 is closed. This suppresses the poured ink from flowing through the communication path 81 into the air chamber 37 (recess 37A) in the course of newly pouring the ink into the tank 9. This also suppresses the poured ink from flowing out of the supply port 63 toward the liquid ejection head 19 in the course of newly pouring the ink into the tank 9. When the amount of ink poured from the inlet port 61 reaches the upper limit in the container portion 35, the operator places the plug 93 in the inlet port 61 and subsequently opens the air communication port 67 and the ink flow path from the supply port 63 to the nozzle 20 of the liquid ejection head 19.

In the attitude of the printer 3 that a liquid is ejectable from the liquid ejection head 19, the plug 93 placed in the inlet port 61 is covered by the cover of the printer 3. This configuration reduces the likelihood that the plug 93 is accidentally removed by, for example, the operator's improper use.

According to this embodiment, the scanner unit 5 or the cover of the printer 3 corresponds to the cover. The plug 93 corresponds to the sealing member. The supply tube 16 corresponds to the tube. The Z-axis direction corresponds to the first direction. The supply port 63 corresponds to the outlet port. The communication path 81 corresponds to the air introducing path.

According to this embodiment, the ink in the container portion 35 is visible through the fourth wall 44 of the tank 9. The window 14 provided in the casing 7 of the printer 3 is located to overlap the fourth wall 44 of the tank 9, so that the ink in the container portion 35 is visible from outside of the casing 7. In this printer 3, this enables the ink in the tank 9 to be visually checked from outside of the casing 7. Additionally, in this printer 3, the longitudinal direction of the container portion 35 is the Z-axis direction. Accordingly, in this printer 3, the ink in the tank 9 is visible from outside of the casing 7 along the longitudinal direction of the container portion 35. This configuration allows the operator to visually check the ink in each tank 9 over the wide range of the container portion 35, thus improving the visibility of ink.

According to this embodiment, in the use state of the printer 3, the Z-axis direction intersects with the horizontal direction. In the attitude that the Z-axis direction intersects with the horizontal direction, the longitudinal direction of the container portion 35 is inclined to the horizontal direction. When the Z-axis direction is the vertical direction, the longitudinal direction of the container portion 35 is perpendicular to the horizontal direction. The ink in the container portion 35 is accordingly accumulated on one end side of the container portion 35 in the longitudinal direction. This facilitates the remaining amount of ink to be visually checked relative to the length of the container portion 35 in the Z-axis direction. In the attitude that the Z-axis direction intersects with the horizontal direction, consumption of a fixed amount of ink 91 provides a larger amount of displacement of the liquid level 91A, compared with in the attitude that the Z-axis direction is along the horizontal direction (i.e., the attitude that the longitudinal direction is the horizontal direction). This is attributed to a difference in sectional area of the container portion 35 in the horizontal direction. In the attitude that the Z-axis direction intersects with the horizontal direction, the remaining amount of ink is more readily recognizable with the eye, compared with the attitude that the Z-axis direction is along the horizontal direction.

Second Embodiment

Figure 8:
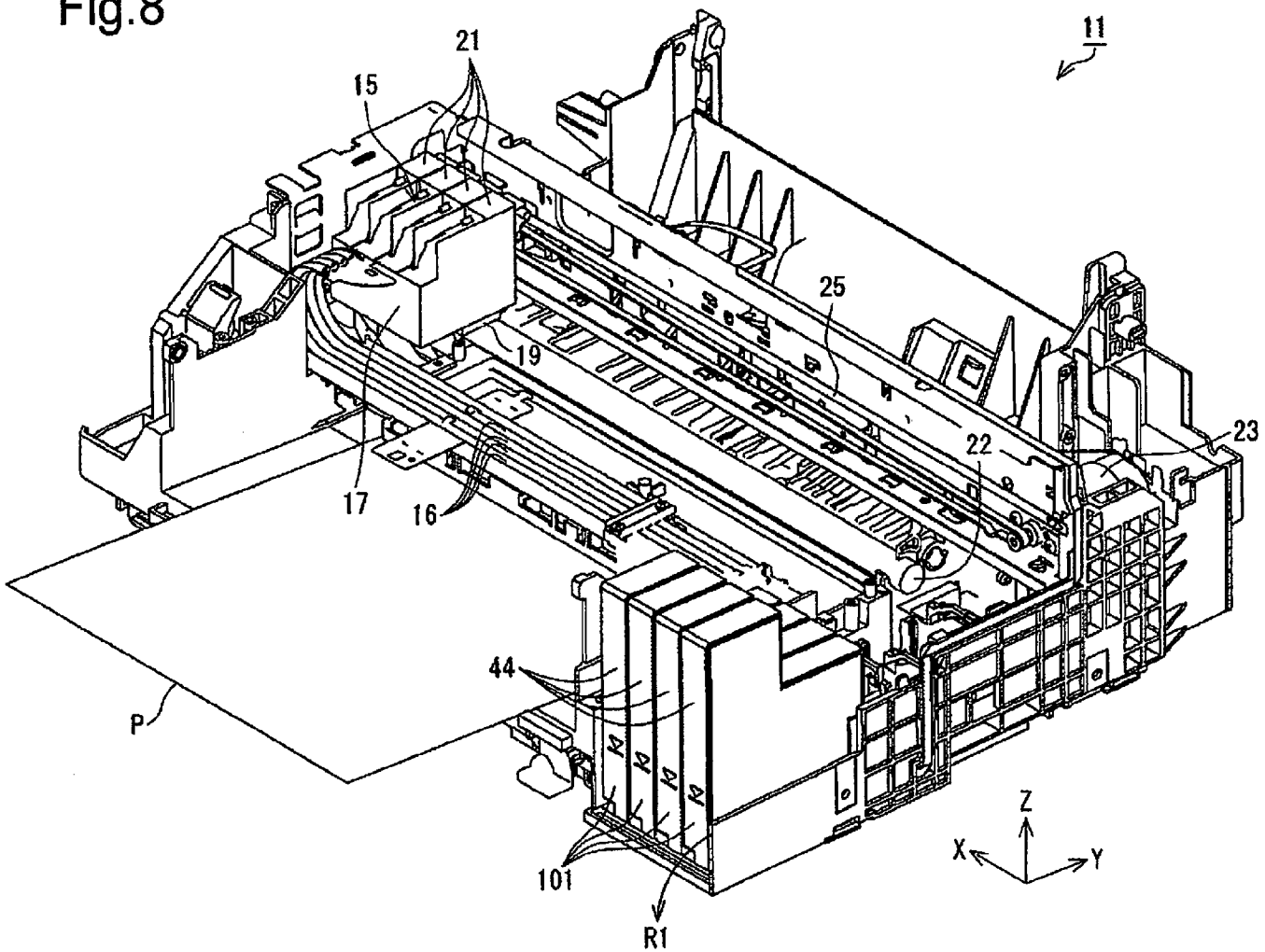
FIG. 8 is a perspective view illustrating mechanics of a printer according to a second embodiment.

A printer 3 according to a second embodiment has four tanks 101 as shown in FIG. 8 that is a perspective view of mechanics 11. In the use state of the printer 3, a fourth wall 44 of each of the tanks 101 faces the front. In the second embodiment, on the other hand, when ink is to be newly poured into the tank 101, the operator rotates the tank 101 in an illustrated direction R1 prior to the pouring operation. In other words, the tanks 101 are configured to be rotatable in the second embodiment.

Figure 9:
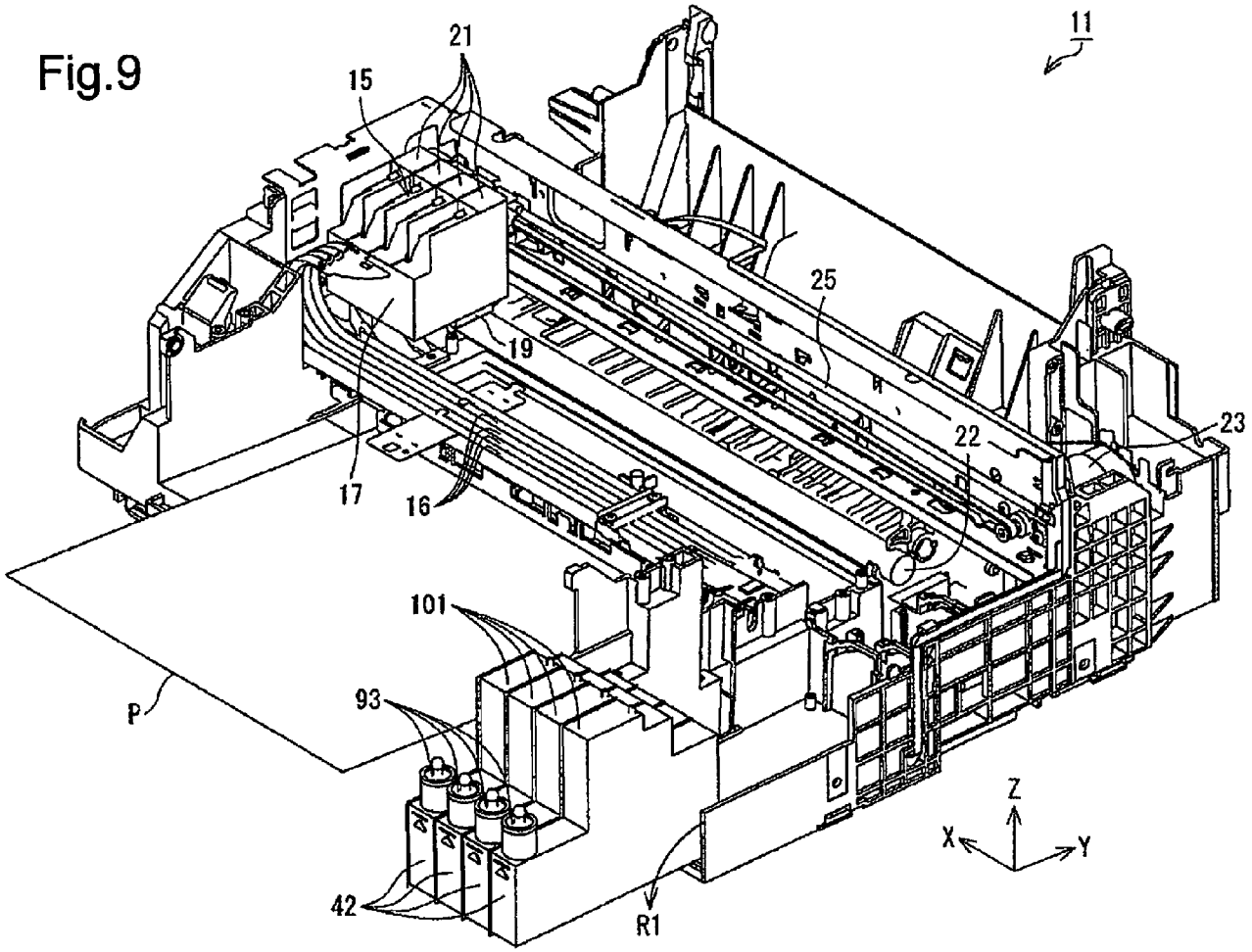
FIG. 9 is a perspective view illustrating the mechanics of the printer of the second embodiment.

When the tank 101 is rotated in the direction R1, the attitude of the tank 101 is changed as shown in FIG. 9. When the tank 101 is rotated in the direction R1, a second wall 42 of the tank 101 faces the front, and a plug 93 provided in an inlet port 61 (described later) of the tank 9 is exposed. As described above, the configuration of the second embodiment is similar to the configuration of the multifunction printer 1 and the printer 3 of the first embodiment, except that the tanks 9 of the first embodiment are replaced with the tanks 101 and that the tanks 101 are configured to be rotatable. Accordingly, in the description below, the identical components to those of the first embodiment are expressed by the identical signs to those of the first embodiment and are not described in detail here.

Figure 10:
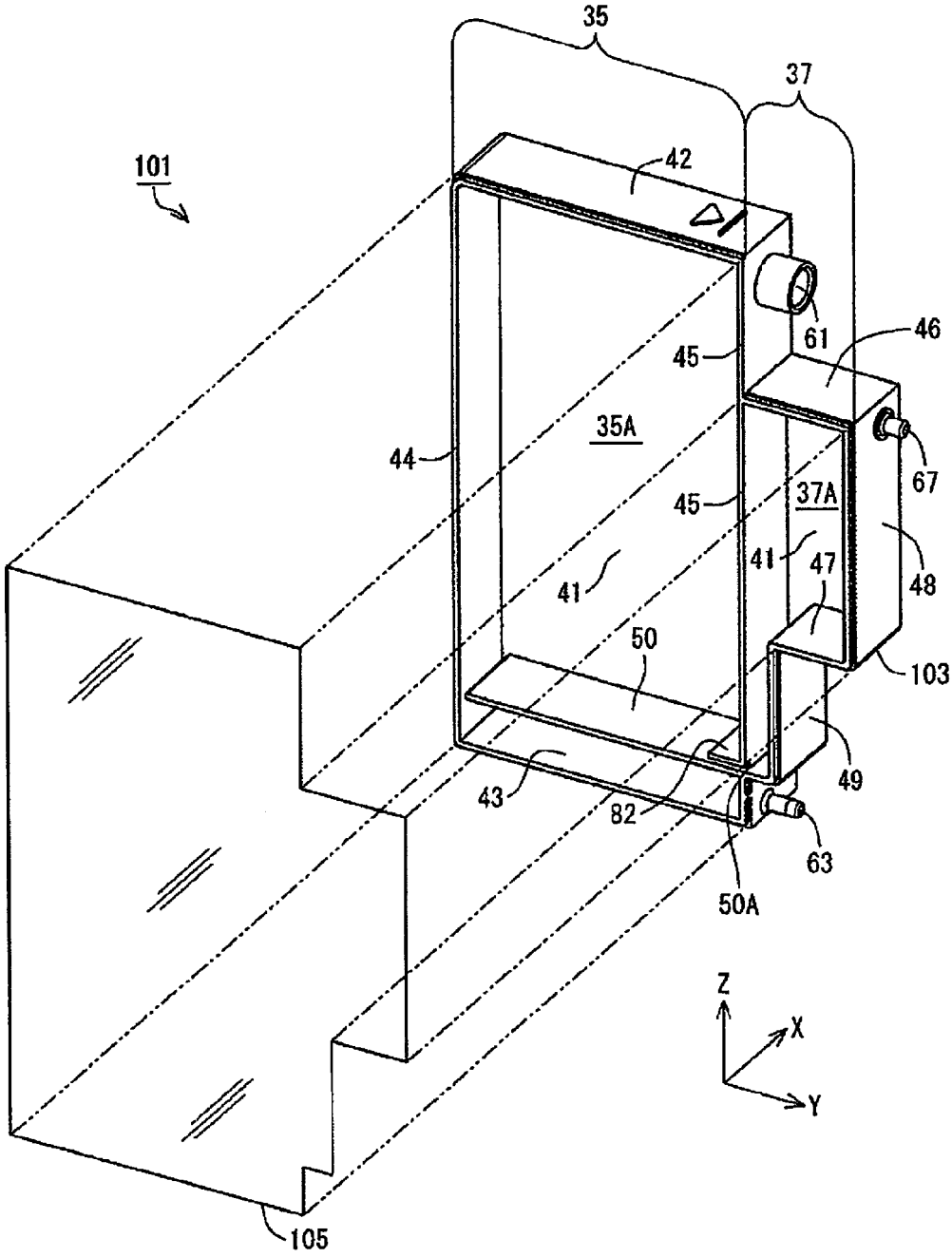
FIG. 10 is an exploded perspective view illustrating the schematic configuration of a tank of the second embodiment.

As shown in FIG. 10, the tank 101 has a casing 103 and a sheet member 105. The casing 103 is made of the same material as that of the casing 31. The sheet member 105 is also made of the same material as that of the sheet member 33. The casing 103 includes a container portion 35 and an air chamber 37. The container portion 35 includes a first wall 41 to a fifth wall 45 and has a similar configuration to that of the first embodiment. The air chamber 37 includes the first wall 41 and a sixth wall 46 to a tenth wall 50 and has a similar configuration to that of the first embodiment. In the second embodiment, the second wall 42 and the sixth wall 46 form a step. In other words, in the second embodiment, the second wall 42 is not continuous with the sixth wall 46.

In the longitudinal direction (Z-axis direction) of the fourth wall 44, the sixth wall 46 is located on a third wall 43-side of the second wall 42. In the longitudinal direction of the fourth wall 44, an inlet port 61 is provided in the fifth wall 45 arranged to connect the second wall 42 with the sixth wall 46. According to the second embodiment, the inlet port 61 is open in a direction intersecting with the longitudinal direction of the fourth wall 44. The sheet member 105 has a similar configuration to that of the sheet member 33 except a portion formed to along the step between the second wall 42 and the sixth wall 46. The supply of ink from the tank 101 to the liquid ejection head 19 and the head difference D1 of the second embodiment are similar to those of the first embodiment and are not specifically described here.

Figure 11:
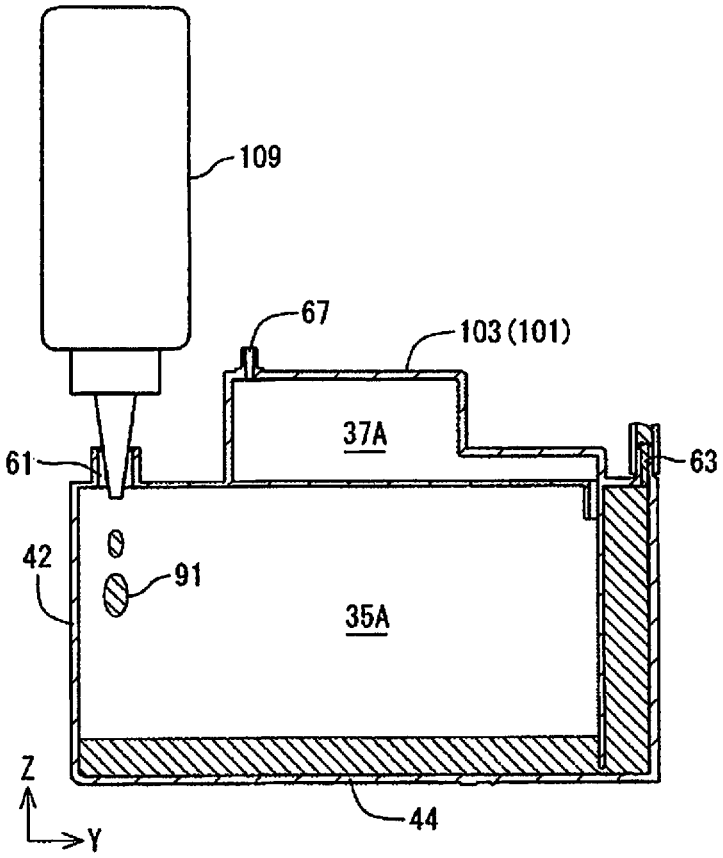
FIG. 11 is a diagram illustrating pouring of ink into the tank of the second embodiment.

According to the second embodiment, when ink is newly poured into the tank 101, the tank 101 is maintained in an attitude that the longitudinal direction of the fourth wall 44 and the vertical direction (Z-axis direction) intersect with each other (hereinafter called pouring attitude) as shown in FIG. 11. In the pouring attitude illustrated in FIG. 11, the longitudinal direction of the fourth wall 44 and the vertical direction (Z-axis direction) are perpendicular to each other. In the pouring attitude, the second wall 42 of the tank 101 faces the front as shown in FIG. 9. In the use state of the printer 3, on the other hand, the longitudinal direction of the fourth wall 44 of the tank 101 and the horizontal direction (XY plane) of the tank 101 are maintained in such an attitude that intersect with each other (hereinafter called use attitude). In the pouring attitude shown in FIG. 11, the operator newly pours ink from a bottle 109 or the like filled with new ink through the inlet port 61 into the tank 101. The second embodiment described above has the similar advantageous effects to those of the first embodiment.

In the attitude of the printer 3 that a liquid is ejectable from the liquid ejection head 19, the plug 93 placed in the inlet port 61 is covered by the cover of the printer 3. This configuration reduces the likelihood that the plug 93 is accidentally removed by, for example, the operator's improper use.

Figure 12:
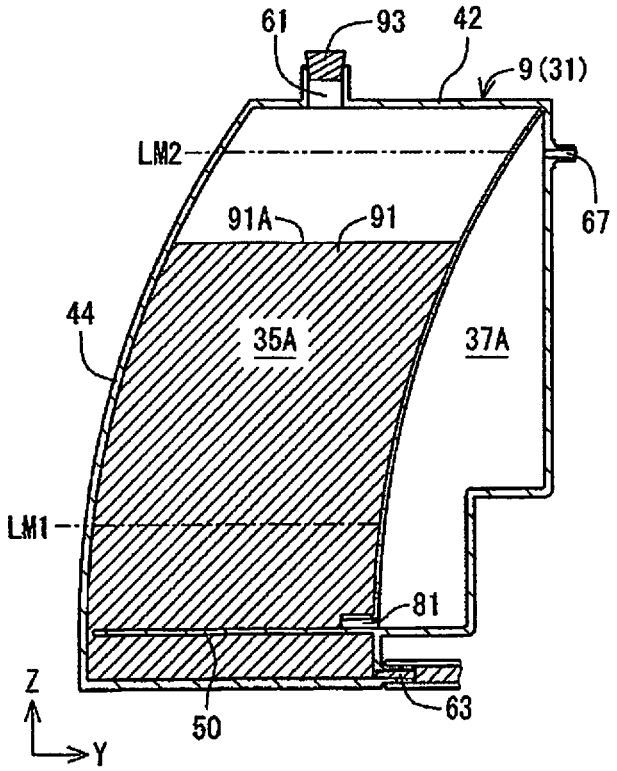
FIG. 12 is a sectional view illustrating another configuration of a tank according to a modification of the embodiment.

With regard to the tank 9 or the tank 101, the sectional area of the container portion 35 in the horizontal direction (XY plane) is preferably constant from the upper limit line LM2 to the lower limit line LM1 in the vertical direction. This configuration provides a constant proportionality factor between the amount of consumption of the ink 91 in the container portion 35 and the amount of displacement of the liquid level 91A. The constant proportionality factor between the amount of consumption of the ink 91 in the container portion 35 and the amount of displacement of the liquid level 91 facilitates a change in the remaining amount of the ink 91 in the container portion 35 to be accurately recognized. In the use attitude, the configuration of the container portion 35 is not limited to the configuration described in the first embodiment or the second embodiment, as long as the sectional area of the container portion 35 in the horizontal direction (XY plane) is constant from the upper limit line LM2 to the lower limit line LM1 in the vertical direction. As long as the sectional area of the container portion 35 is constant in the use attitude, the container portion 35 may employ a configuration that the fourth wall 44 and the fifth wall 45 are formed by curved surfaces as shown in FIG. 12.

In the respective embodiments described above, when the liquid ejection apparatus has the functions of the printer 3 but does not have the functions of the scanner unit 5, the cover of the printer 3 arranged to cover the plug 93 may have any configuration that covers the casing 7. In this modified application, the casing 7 may be formed integrally with the cover of the printer 3.

In the respective embodiments described above, the liquid ejection apparatus may be a liquid ejection apparatus that sprays, ejects or applies and thereby consumes a liquid other than ink. The liquid ejected in the form of very small amounts of droplets from the liquid ejection apparatus may be in a granular shape, a teardrop shape or a tapered threadlike shape. The liquid herein may be any material consumed in the liquid ejection apparatus. The liquid may be any material in the liquid phase and may include liquid-state materials of high viscosity or low viscosity, sols, aqueous gels and other liquid-state materials including inorganic solvents, organic solvents, solutions, liquid resins and liquid metals (metal melts). The liquid is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiments and liquid crystal. The ink herein includes general water-based inks and oil-based inks, as well as various liquid compositions, such as gel inks and hot-melt inks. A concrete example of the liquid consuming apparatus may be a liquid ejection apparatus that ejects a liquid in the form of a dispersion or a solution containing a material such as an electrode material or a color material used for production of liquid crystal displays, EL (electroluminescent) displays, surface emission displays and color filters. The liquid ejection apparatus may also be a liquid ejection apparatus that ejects a bioorganic material used for manufacturing biochips, a liquid ejection apparatus that is used as a precision pipette and ejects a liquid as a sample, a printing apparatus or a microdispenser. Additionally, the liquid ejection apparatus may be a liquid ejection apparatus for pinpoint ejection of lubricating oil on precision machines such as machines and cameras or a liquid ejection apparatus that ejects a transparent resin solution of, for example, an ultraviolet curable resin, onto a substrate to manufacture a hemispherical microlens (optical lens) used for optical communication elements and the like. As another example, the liquid ejection apparatus may be a liquid ejection apparatus that ejects an acidic or alkaline etching solution to etch a substrate or the like.

REFERENCE SIGNS LIST

1 multifunction printer; 3 printer; 5 scanner unit; 7 casing; 9 tank; 11 mechanics; 12 operation panel; 14 window; 15 liquid ejection assembly; 16 supply tube; 17 carriage; 19 liquid ejection head; 20 nozzle; 21 relay unit; 31 casing; 35A recess; 33 sheet member; 35 container portion; 37 air chamber; 37A recess; 41 first wall; 42 second wall; 43 third wall; 44 fourth wall; 45 fifth wall; 46 sixth wall; 47 seventh wall; 48 eighth wall; 49 ninth wall; 50 tenth wall; 50A cutout; 50B surface; 61 inlet port; 63 supply port; 67 air communication port; 81 communication path; 82 partition wall; 91 ink; 91A liquid level; 93 plug; 95 supply path; 97 the air; 101 tank; 103 casing; 105 sheet member; and P printing medium.

The invention claimed is:

1. A liquid ejection apparatus, comprising:

a tank configured to contain a liquid;

a liquid ejection head communicated with the tank and configured to eject the liquid;

a casing configured to place the tank and the liquid ejection head inside thereof; and a cover configured to cover the casing, the tank is configured to be rotatable to the casing to a font side, the tank includes:

a wall which is covered by the cover in the use state of the liquid ejection device and which is exposed when the tank is rotated to the front side;

a container assembly configured to contain the liquids;

an air introducing path arranged to introduce the air into the container assembly;

a filler port provided on the wall, and configured to inject the liquid into the container assembly;

a sealing member configured to seal the filler port; and an outlet port formed to supply the liquid through a tube into the liquid ejection head, and in an attitude that the liquid is ejectable from the liquid ejection head, the liquid being contained in the container assembly such that a liquid level of the liquid in the container assembly is located at a higher position than a nozzle of the liquid ejection head in a vertical direction; an inlet port, which is an opening of the air introducing path on a container assembly side thereof, being located at a lower position than the nozzle of the liquid ejection head in the vertical direction; and the sealing member being covered by part of the cover.

2. The liquid ejection apparatus according to claim 1, wherein the cover constitutes part of a scanner unit.

3. The liquid ejection apparatus according to claim 1, wherein the tank further comprises an air chamber communicated with the container assembly via the air introducing path, and an air communication port formed to introduce the air into the air chamber.

4. The liquid ejection apparatus according to claim 1, wherein the container assembly is extended in a first direction that is a longitudinal direction of the container assembly, a dimension of the container assembly in the first direction is longer than a dimension of the container assembly in a direction perpendicular to the first direction, at least part of an area of the tank, which is overlapping the container assembly, has optical transparency along the first direction, and at least an area of the casing, which is overlapping the part of the area of the tank having optical transparency, has optical transparency.

5. The liquid ejection apparatus according to claim 4, wherein the first direction intersects with a horizontal direction.

6. The liquid ejection apparatus according to claim 4, wherein a sectional area of the container assembly, which is cut in a direction perpendicular to the first direction, is constant along the first direction.

7. A liquid ejection device, comprising:

a tank that is configured to contain a liquid;

a liquid ejection head that communicates with the tank and is configured to eject the liquid;

a casing that is configured to place the tank and the liquid ejection head inside thereof, the casing includes an optically transparent area on a front face, and a cover that is configured to cover the casing, wherein the tank includes:

a container assembly that is configured to contain the liquid;

an air introducing path that is arranged to introduce the air into the container assembly;

a filler port that is provided on the container assembly and configured to inject the liquid into the container assembly;

a sealing member that is configured to seal the filler port;

an outlet port that is formed to supply the liquid through a tube into the liquid ejection head; and a wall that faces to the optically transparent area, the wall has a limit line indicating a limit of the amount of the liquid contained in the container assembly so that the limit line is visible through the optically transparent area.

8. The liquid ejection device according to claim 7, wherein the cover constitutes part of a scanner unit.

9. The liquid ejection device according to claim 7, wherein the tank further includes an air chamber that communicates with the container assembly via the air introducing path, and an air communication port that is formed to introduce the air into the air chamber.

10. The liquid ejection device according to claims 7, wherein the container assembly is extended in a first direction that is a longitudinal direction of the container assembly, a dimension of the container assembly in the first direction is longer than a dimension of the container assembly in a direction perpendicular to the first direction, at least part of an area of the tank overlapping the container assembly has optical transparency along the first direction, and at least an area of the casing overlapping the part of the area of the tank having optical transparency has optical transparency.

11. The liquid ejection device according to claim 10, wherein the first direction intersects with a horizontal direction.

12. The liquid ejection device according to claim 10, wherein a sectional area of the container assembly cut in a direction perpendicular to the first direction is constant along the first direction.

* * * * *